US005456946A

United States Patent [19]

Snellman

[11] Patent Number: 5,456,946

[45] Date of Patent: Oct. 10, 1995

[54] METHOD FOR THE COATINGS OF THE CENTER ROLL IN THE PRESS OF A PAPER MACHINE AND A CENTER ROLL IN THE PRESS OF A PAPER MACHINE

[75] Inventor: Jorma Snellman, Jyväskylä, Finland

[73] Assignee: Valmet Paper Machinery, Inc., Helsinki, Finland

[21] Appl. No.: 249,844

[22] Filed: May 26, 1994

Related U.S. Application Data

[63] Continuation of Ser. No. 46,458, Apr. 12, 1993, abandoned.

[30] Foreign Application Priority Data

Apr. 14, 1992 [FI] Finland ..... 921680

[51] Int. Cl.[6] ..... B05D 1/32; B05D 3/00; B05D 5/00

[52] U.S. Cl. ..... 427/272; 29/895.211; 29/895.23; 29/895.32; 427/282; 427/287; 492/30; 492/37; 492/53; 492/56

[58] Field of Search ..... 29/895.211, 895.23, 29/895.32; 492/56, 53, 30, 37; 427/272, 274, 282, 286, 287

[56] References Cited

U.S. PATENT DOCUMENTS

| | | | |
|---|---|---|---|
| 2,288,675 | 7/1942 | Berry | 492/30 |
| 3,852,861 | 12/1974 | Baker et al. | 492/53 |
| 3,942,230 | 3/1976 | Nalband | 492/53 |
| 4,518,460 | 5/1985 | Hauser et al. | 492/30 |
| 4,559,106 | 12/1985 | Skytta et al. | 492/30 |
| 4,693,784 | 9/1987 | Aula et al. | 492/30 |
| 4,951,392 | 8/1990 | Miihkinen | 29/895.211 |
| 5,023,985 | 6/1991 | Salo et al. | 29/132 |
| 5,056,220 | 10/1991 | Telama | 29/895.32 |
| 5,065,193 | 11/1991 | Saitoh et al. | 29/895 |
| 5,111,567 | 5/1992 | Leino et al. | 29/132 |
| 5,111,568 | 5/1992 | Telama | 29/132 |
| 5,138,766 | 8/1992 | Kimura et al. | 29/895.212 |
| 5,186,849 | 2/1993 | Kobayashi | 29/895.32 |
| 5,188,273 | 2/1993 | Schmoock | 492/30 |
| 5,257,966 | 11/1993 | Watanabe et al. | 492/53 X |

FOREIGN PATENT DOCUMENTS

| | | |
|---|---|---|
| 487201 | 10/1952 | Canada . |
| 2052925 | 4/1992 | Canada . |
| 70273 | 2/1986 | Finland . |
| 914721 | 4/1992 | Finland . |

*Primary Examiner*—Michael Lusignan
*Attorney, Agent, or Firm*—Steinberg, Raskin & Davidson

[57] ABSTRACT

The invention relates to a method for coating a center roll used in a press of a paper machine and a center roll in the paper machine. The center roll in the paper machine is made of a ceramic or metal-ceramic basic material. At least one portion of the center roll is coated or soaked with a polymer coating in order to obtain a desired adhesion properties of the face of the center roll.

21 Claims, 3 Drawing Sheets

FIG. 4
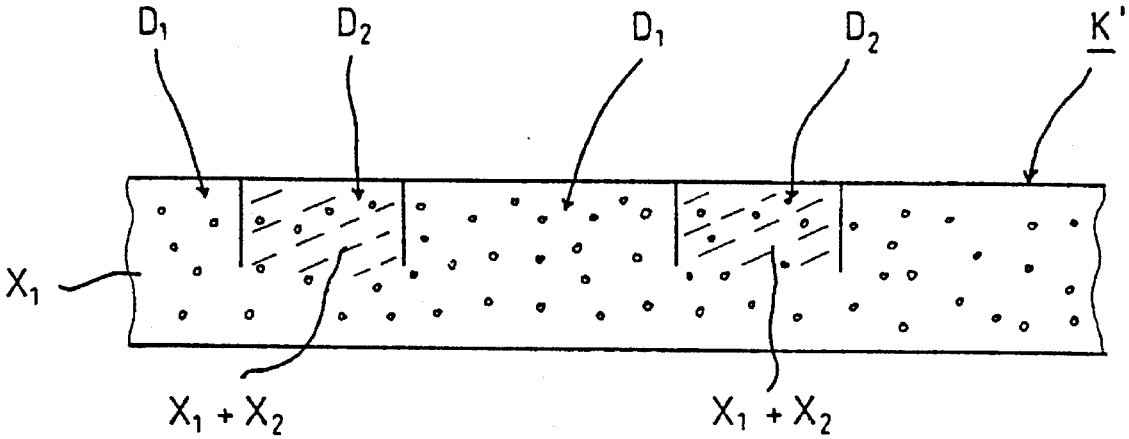
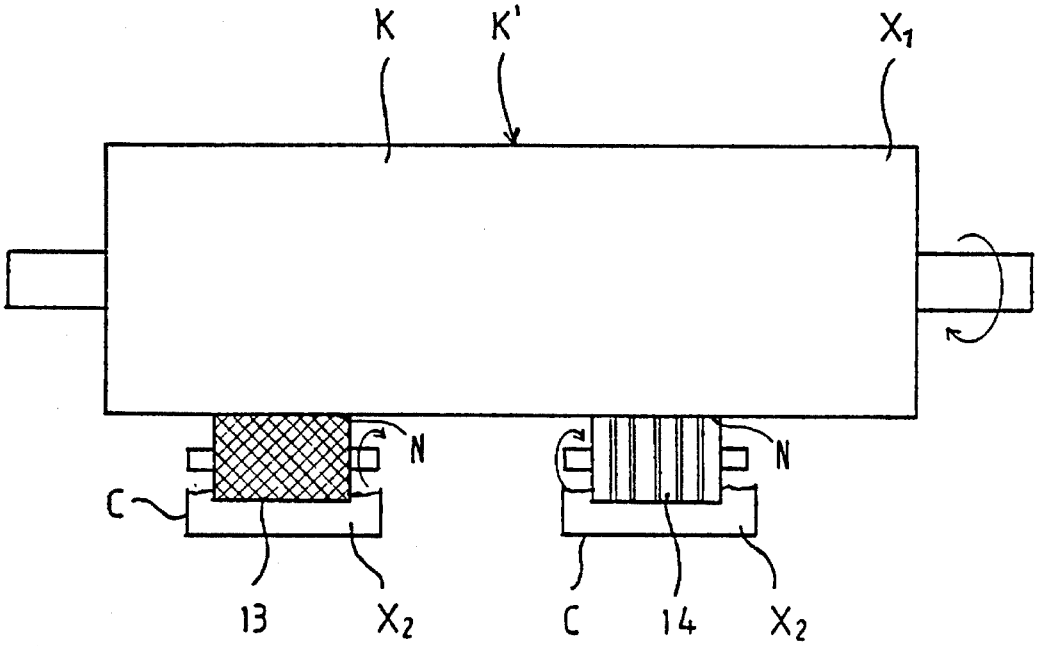
FIG. 3

METHOD FOR THE COATINGS OF THE CENTER ROLL IN THE PRESS OF A PAPER MACHINE AND A CENTER ROLL IN THE PRESS OF A PAPER MACHINE

This is a continuation, of application Ser. No. 08/046,458, filed Apr. 12, 1993, now abandoned.

BACKGROUND OF THE INVENTION

The present invention relates to a method for coating a press roll and in particular a center roll used in the press section of a paper machine. The invention also relates to a center roll formed by the method and used in a press section of a paper machine.

At present, center rolls used in press sections of paper machines are coated with a ceramic. However, when ceramic center rolls are employed in the press section, it is difficult to control the properties of separation and/or adhesion of the paper web.

Impregnation of a ceramic coating with plastic is known in the prior art. However, this technique has been applied so that the whole face of the roll is treated, in which case pores present in the roll face are fully or partly filled with plastic. In such an embodiment, all of the surface properties of the roll are changed, and it is a significant drawback that the desired, advantageous properties of a pure non-impregnated ceramic cannot be utilized.

OBJECTS AND SUMMARY OF THE INVENTION

It is an object of the present invention to provide a new and improved method for coating a center roll used in a press section in order to obtain improved control over the properties of separation and/or adhesion of the web to the center roll.

It is another object of the present invention to provide a new and improved method for coating a roll and a center roll used in a press section in which the drawbacks of the prior art are eliminated.

In view of achieving these objects and others, in the present invention, the center roll is coated in such a manner that the ceramic roll face is partially coated with a plastic only, for example, Teflon-coated. This advantageous coating produces the convenient separation of the web from the roll face. The non-Teflon-coated portions of the roll guarantee an adequate adhesion of the roll face, so that the paper web does not follow, e.g., the pick-up felt after a second nip in the press section.

According to the present invention, the property of the separation and/or adhesion of the web to the web-contacting surface of the center roll are adjustable by varying the ratio of the area of coated face to the area of uncoated face. The coating can be carried out, for example, by covering the roll with perforated or grooved tape and by spraying a fluoroplastic into the roll face through the grooves and/or perforations in the tape. The fluoro-plastic may be, e.g., polytetrafluoroethylene (PTFE), co-polymer of tetrafluoroethylene and hexafluoropropylene (FEP), polychlorotrifluoroethylene (PCTFE), perfluoroalkoxy (PFA), and polyvinylidenefluoride (PVDF). After the spraying is finished, the perforated tape is removed, and the plastic is polymerized in an oven. The coating agent may also be applied by means of a raster-faced or grooved roll.

It is possible to manufacture a ceramic center roll of a novel type by treating only specific circumferential portions of the roll face by means of the method in accordance with the invention. Owing to the inherent nature of the ceramic coating, a uniform surface structure is obtained as the coating agent is carried by absorption into the porous ceramic or metal-ceramic base material. Preferably, the base ceramic $X_1$ of the center roll K may be an oxide ceramic, such as Zr, Al, Si, Ti, Y, Cr oxide, a carbide ceramic, such as Cr, W, Ti, Nb carbide, or a boride ceramic, such as Fe, Cr, Ti boride, or a mixture or compound of any of these substances. In a preferred embodiment, metals, such as Al, Cr, Ni, Co, may have been alloyed into the above mentioned ceramics.

In another embodiment, it is possible to employ one or several so-called adhesion layers to ensure reliable adhesion of the ceramic or metal-ceramic layer. The adhesion layers are applied under the ceramic or metal-ceramic coating and in contact with the roll body. The adhesion layer is preferably a thin, thermally sprayed metal layer with minimal porosity. The thickness of the ceramic or metal-ceramic coating is from about 0.05 mm to about 4 mm, preferably from about 0.5 mm to about 2 mm.

The invention permits the manufacture of a roll with a roll face providing an adhesion force that varies in the direction of the roll circumference, i.e. in the running direction of the paper web. Thus, the roll face can be selected, e.g., in view of the desired doctoring properties. It is an important feature of a center roll formed by the method in accordance with the invention that the wear of a roll is substantially uniform because the hardness of the coated roll area is substantially equal to the hardness of the uncoated roll area.

In the method in accordance with the invention, the desired portions of the center roll are coated or soaked with a polymer in view of obtaining the desired adhesion properties of the roll face of the center roll.

The center roll in accordance with the invention, and preferably for use in a paper machine press section, comprises a coating layer which consists of a polymer and which has been absorbed into the ceramic or metal-ceramic basic material which constitutes the roll body.

BRIEF DESCRIPTION OF THE DRAWINGS

The following drawings are illustrative of embodiments of the invention and are not meant to limit the scope of the invention as encompassed by the claims.

FIG. 3 illustrates a second preferred embodiment of the center roll and method for coating a center roll in accordance with the invention.

FIG. 4 is a sectional view of the roll surface of a center roll into which a coating agent has been absorbed.

DETAILED DESCRIPTION OF THE INVENTION

Figure 1:
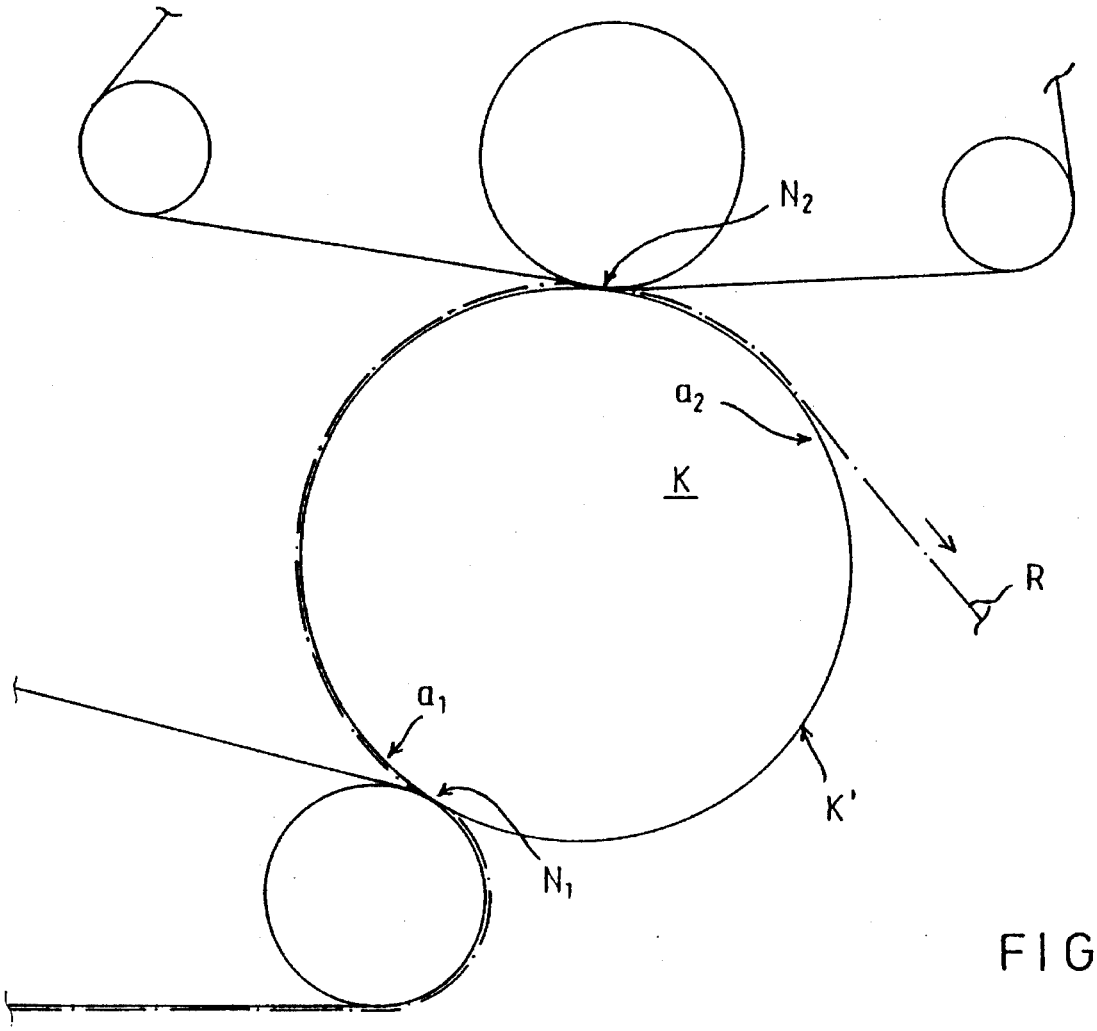
FIG. 1 illustrates the problem areas of the separation and adhesion of the web occurring in the operation of a center roll in a press section of a paper machine.

FIG. 1 is a schematic illustration of a pair of nips $N_1$ and $N_2$ arranged in connection with a center roll K in a press section of a paper machine. A paper web or board R is passed from a wire or felt in nip $N_1$ onto a roll face of the center roll K. The web runs along the surface of the center roll K through nip $N_2$. From nip $N_2$, the web runs further along the roll face K' of the center roll K a distance until the web R is separated from the roll face. It is advantageous that the paper web R adhere to the roll face in an area $a_1$ of the center roll K. Adhesion provided by the roll face of center roll K is important in this area in order to hold the paper web R on the face of the center roll K. In a corresponding manner, the web is guided away from the face of the center roll K in area $a_2$ such that a lower adhesion force is required from the face in order that the paper web should be detached from the roll faces as well as possible. Thus, in the areas $a_1$ and $a_2$, the separation and adhesion properties required from the face K' of the center roll K are contradictory to each other. Therefore, with respect to the center-roll operations, the roll face must be selected separately from case to case depending on the application of the center roll in the press section.

In the method of the invention, a coating $X_2$ for the center roll K is selected variably. Coating $X_2$ is preferably a polymer. In accordance with the present invention, a plastic coating 21 is soaked into the roll face. The plastic coating 21 is preferably a Teflon coating such as polytetrafluoroethylene (PTFE). The coating may also be another fluoro-plastic such as polychlorotrifluoroethylene (PCTFE), perfluoroalkoxy (PFA), polyvinylidenefluoride (PVDF), or a copolymer of tetrafluoroethylene and hexafluoropropylene.

Figure 2:
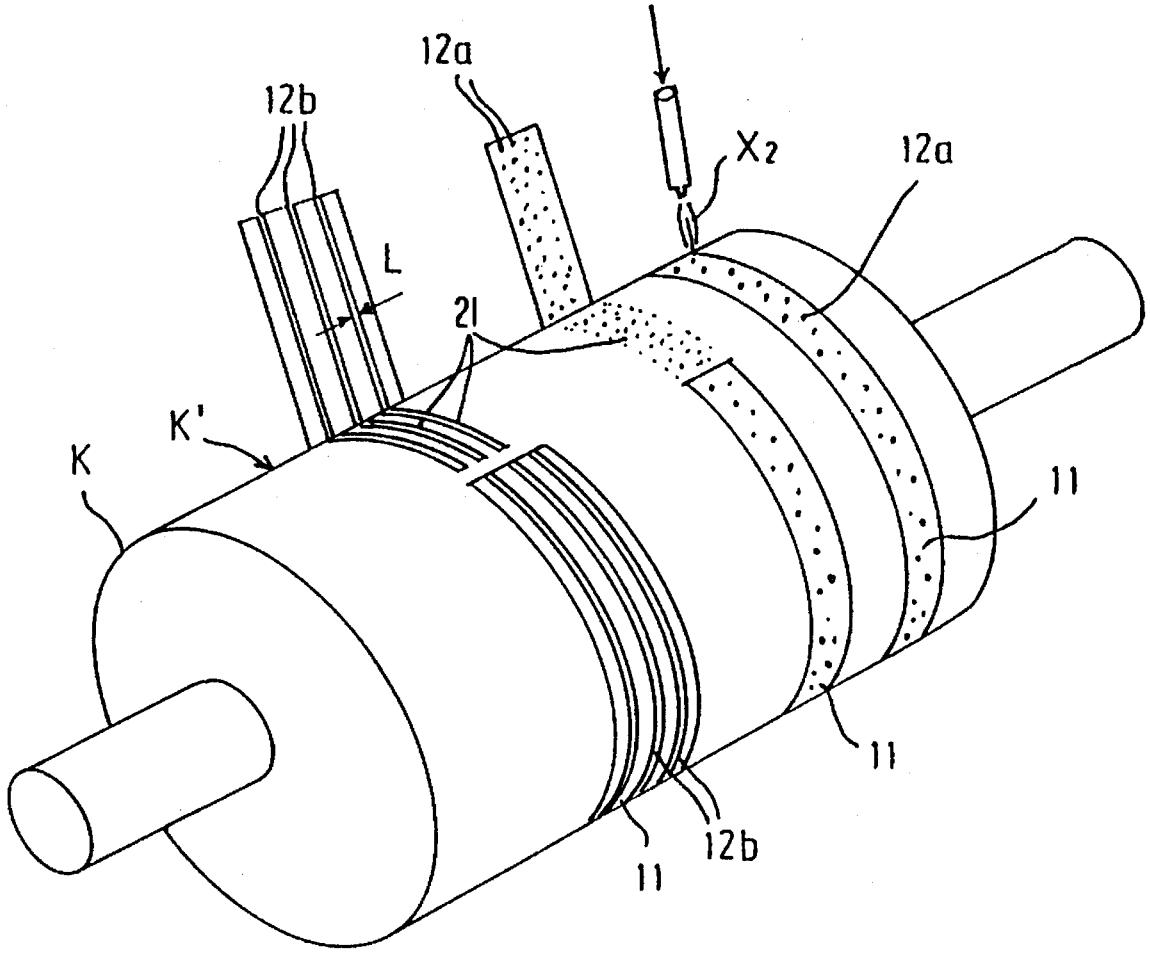
FIG. 2 illustrates a first preferred embodiment of the center roll and method for coating a center roll in accordance with the invention.

As shown in FIG. 2, the coating agent $X_2$ is spread by a coating process such as spraying. As the roll is only partially coated, i.e. only specific circumferential portions of the roll are coated, the portions of the roll that are not to be coated are covered with a tape 11 which is grooved and/or perforated 12*a*, 12*b*. Thus, the coating is applied to a portion only of the circumference of the roll face of the center roll such that at least one complete circumferential portion along the axial length of the center roll is not coated. FIG. 2 shows the stage in the method in which the tapes 11 are removed after the coating agent has been sprayed onto the roll surface over the portions selected to be coated. By varying the perforations 12*a* and/or grooves 12*b* in the tape, the roll face can be provided with the desired patterned form and, thus with the desired adhesion force.

The adhesion force of the roll can be varied, for example, across the length of the roll, by providing that the ratio of the uncoated portions of the roll face to coated portions of the roll face is varied. This ratio is adjustable, e.g., by varying the size of the perforations 12*a* in the tape 11 and/or by varying the spacing of the perforations in the tape 11. It is also possible to vary the groove width (L) and/or the spacing of the grooves 12*b* in the tape 11. The tape 11 may be perforated before and/or after it is applied onto the roll face. After the coating stage is completed, the tape 11 is removed and the coating is polymerized by, e.g., heating the roll in an oven.

FIG. 3 illustrates another embodiment of the coating in accordance with the invention wherein the same reference numerals indicated the same elements as set forth and described in the embodiments of FIGS. 1 and 2. The coating agent is applied to the roll face K' of the center roll K by means of a rasterized and/or grooved roll 13, 14. The center roll K is rotated in contact with the rasterized rolls 13, 14. The rasterized rolls 13, 14 are placed partly in a basin C that contains the coating agent $X_2$. The coating agent $X_2$ adheres to a face of the rasterized rolls 13, 14. As the rolls K, 13, 14 revolve, the coating agent is transferred to an application area on the face K' of the center roll K from the face of the rasterized roll 13, 14 in a nip N defined between the rasterized rolls 13, 14 and the center roll K.

It is possible to manufacture rolls having an adhesion force which is higher in the middle area of the roll face than at the edges of the roll by means of the method of the invention. It is also possible to manufacture rolls whose face has a higher adhesion in the lateral areas of the roll as compared with the middle area of the roll. The coating form and the coating area can be chosen in accordance with the requirements imposed by the operation of the roll in each particular case for each specific press section arrangement.

FIG. 4 is a sectional view of the face of a center roll K in accordance with the invention wherein the same reference numerals indicated the same elements as set forth and described in the embodiments of FIGS. 1–3. In FIG. 4, a material $X_1$ of an area $D_1$ consists of a ceramic basic material into which the coating agent X2 has been impregnated or soaked in an area D2. The base-material ceramic $X_1$ may be an oxide ceramic, such as Zr, Al, Si, Ti, Y, Cr oxide, a carbide ceramic, such as Cr, W, Ti, Nb carbide, a boride ceramic, such as Fe, Cr, Ti boride, or a mixture or compound of any of these ceramic materials. Metals, such as Al, Cr, Ni, Co, may be alloyed into the above ceramics. The coating agent $X_2$ absorbed into the ceramic roll face is preferably a fluoro-plastic, such as polytetrafluoroethylene (PTFE), a co-polymer of tetrafluoroethylene and hexafluoropropylene (FEP), polychlorotrifluoroethylene (PCTFE), perfluoroalkoxy (PFA), or polyvinylidenefluoride (PVDF).

The use of a coating method in accordance with the invention permits variation of the surface properties on a very small scale, i.e. very fine adjustments are possible. In addition, it is possible to provide the roll face of the center roll with a desired pattern form in which the roll face and the coating-agent face alternate in the desired manner. The wear of the center roll K in accordance with the invention is substantially uniform because the hardness of the materials $X_1+X_2$ in the coated area $D_2$ of the roll is substantially equal to the hardness of the basic material $X_1$ in the uncoated area $D_1$ of the roll.

The present invention describes the use of a coating method for coating a center roll of a press section in a paper machine. As known in the art, the center roll is preferably solid. However, the present invention may also be used for a roll having a roll mantle of a base material which is a ceramic or metal-ceramic compound. The coating agent in accordance with the invention is then applied to the roll mantle.

The examples provided above are not meant to be exclusive. Many other variations of the present invention would be obvious to those skilled in the art, and are contemplated to be within the scope of the appended claims.

I claim:

1. A method for coating a center roll used in a press of a paper machine for regulating adhesion of a web to a web-contacting surface of the center roll, comprising the steps of:

providing a center roll with a ceramic or metal-ceramic base material, applying a polymer coating to a first region of the web-contacting surface of the center roll, and maintaining a second region of the web-contacting surface in an uncoated state.

2. The method of claim 1, wherein the coating is a fluoro-plastic.

3. The method of claim 1, wherein the coating is polytetrafluoroethylene.

4. The method of claim 2, wherein the coating is a co-polymer of tetrafluoroethylene and hexafluoropropylene, polychlorotrifluoroethylene, perfluoroalkoxy, or polyvinylidenefluoride.

5. The method of claim 1, further comprising spraying the coating onto the web-contacting surface to coat said first region.

6. The method of claim 1, further comprising soaking said first region of the web-contacting surface with the coating.

7. The method of claim 1, further comprising the step of covering the web-contacting surface with a perforated tape before the coating is applied to the web-contacting surface, and introducing the coating onto the first region of the web-contacting surface through the perforations in the tape.

8. The method of claim 7, further comprising the step of adjusting the adhesion force of the web-contacting surface to the web by varying the proportion of the area of the perforations in the tape or by varying at least one of the size and the spacing of the perforations in the tape.

9. The method of claim 1, further comprising applying the coating onto a rasterized and/or grooved roll from a basin containing the coating, and transferring the coating from the rasterized and/or grooved roll to the roll face of the center roll in a nip defined between the rasterized and/or grooved roll and the center roll.

10. The method of claim 1, further comprising polymerizing the coating by means of a heat treatment after the coating has been applied to the roll face.

11. The method of claim 1, further comprising the step of covering the web-contacting surface with a grooved tape before the coating is applied to the web-contacting surface, and introducing the coating onto the web-contacting surface through the grooves in the tape.

12. The method of claim 1, further comprising the step of adjusting the adhesion force of the web-contacting surface to the web by varying the proportion of the area of the grooves in the tape or by varying at least one of the groove width and the spacing of the grooves in the tape.

13. The method of claim 1, wherein said second region comprises at least one complete circumferential portion along the axial length of the center roll.

14. The method of claim 1, wherein the polymer coating is applied to the web-contacting surface of the center roll such that adhesion properties of the web-contacting surface to the web vary in an axial direction of the center roll.

15. A method for coating a center roll used in a press of a paper machine, comprising the steps of:

providing a center roll with a ceramic or metal-ceramic base material, and applying a polymer coating to a portion only of a circumference of a roll face of the center roll by soaking said portion of the roll face with the coating such that at least one complete circumferential portion along the axial length of the center roll is not coated with the polymer coating and the roll face has different adhesion properties to a paper web or board running over the roll face of the center roll in an axial direction thereof.

16. The method of claim 15, further comprising the step of polymerizing the coating by means of a heat treatment after the coating has been applied onto the roll face.

17. A method for coating a center roll used in a press of a paper machine, comprising the steps of:

providing a center roll with a ceramic or metal-ceramic base material, and applying a polymer coating to a portion only of a circumference of a roll face of the center roll such that at least one complete circumferential portion along the axial length of the center roll is not coated with the polymer coating and the roll face has different adhesion properties to a paper web or board running over the roll face of the center roll in an axial direction thereof, said polymer coating application step comprising the steps of covering the roll face with a perforated and/or grooved tape before the coating is applied to the roll face, and introducing the coating onto the roll face through the perforations and/or grooves in the tape.

18. The method of claim 17, further comprising the step of polymerizing the coating by means of a heat treatment after the coating has been applied onto the roll face.

19. The method of claim 17, further comprising the step of adjusting the adhesion force of the roll face to the web by varying the proportion of the area of the perforations and/or grooves in the tape.

20. The method of claim 17, further comprising the step of adjusting the adhesion force of the roll face to the web by varying the groove width and/or the size of the perforations in the tape.

21. The method of claim 17, further comprising the step of adjusting the adhesion force of the roll face to the web by varying the spacing of the perforations in the tape.

* * * * *